US006449781B1

(12) United States Patent
Sondov

(10) Patent No.: US 6,449,781 B1
(45) Date of Patent: Sep. 17, 2002

(54) APPARATUS FOR FLUSHING IN A LIQUID SYSTEM

(75) Inventor: Sten Yngvar Sondov, Tønsberg (NO)

(73) Assignee: Cleanpipe AS, Tønsberg (NO)

( * ) Notice: Subject to any disclaimer, the term of this patent is extended or adjusted under 35 U.S.C. 154(b) by 0 days.

(21) Appl. No.: 09/762,969

(22) PCT Filed: Sep. 3, 1998

(86) PCT No.: PCT/NO98/00269

§ 371 (c)(1),
(2), (4) Date: May 15, 2001

(87) PCT Pub. No.: WO00/14347

PCT Pub. Date: Mar. 16, 2000

(51) Int. Cl.[7] ..... F16K 21/18
(52) U.S. Cl. ..... 4/300; 137/579; 137/396
(58) Field of Search ..... 4/300, 340–342, 4/345, 415; 137/395, 396, 403, 577, 579

(56) References Cited

U.S. PATENT DOCUMENTS

| | | | | |
|---|---|---|---|---|
| 284,976 A | * | 9/1883 | Parfitt | 4/430 |
| 741,203 A | * | 10/1903 | Williams | |
| 1,203,106 A | * | 10/1916 | Fulton | |
| 3,375,851 A | * | 4/1968 | FitzHenry et al. | |
| 4,114,203 A | * | 9/1978 | Carolan | |
| 4,242,765 A | | 1/1981 | Russell | |
| 4,321,948 A | * | 3/1982 | Bradley | |

FOREIGN PATENT DOCUMENTS

| | | | |
|---|---|---|---|
| DE | 3428500 A | | 2/1986 |
| FR | 2 720 424 A1 | * | 12/1995 |
| GB | 1441631 A | | 7/1976 |
| NO | 951470 A | | 10/1996 |

* cited by examiner

*Primary Examiner*—Charles H. Eloshway
(74) *Attorney, Agent, or Firm*—Rothwell, Figg, Ernst & Manbeck

(57) ABSTRACT

An apparatus for shock-like flushing in a fluid system, comprising an accumulating or blocking element (13) which upon supply of fluid from an inlet (2) is adapted to be set from a normal position to a flushing position where accumulated fluid flows through an outlet (14) to a following section of the fluid system, and to subsequently be reset to normal position. The blocking element comprises a canal, duct or pipe member (13) with a rotational portion (17) at an upstream end and with a normal position for blocking and accumulating fluid in the canal, duct or pipe member (13). The blocking element is kept at an inclination in the normal position by means of a spring or weight load (15) until a certain level of accumulated fluid is attained. Further, the blocking element can be lowered to the flushing position. The spring or weight load (15) is adapted to bring the blocking element (13) back from the flushing position to normal inclined position when a certain low fluid level is attained.

8 Claims, 5 Drawing Sheets

APPARATUS FOR FLUSHING IN A LIQUID SYSTEM

Figure 1:
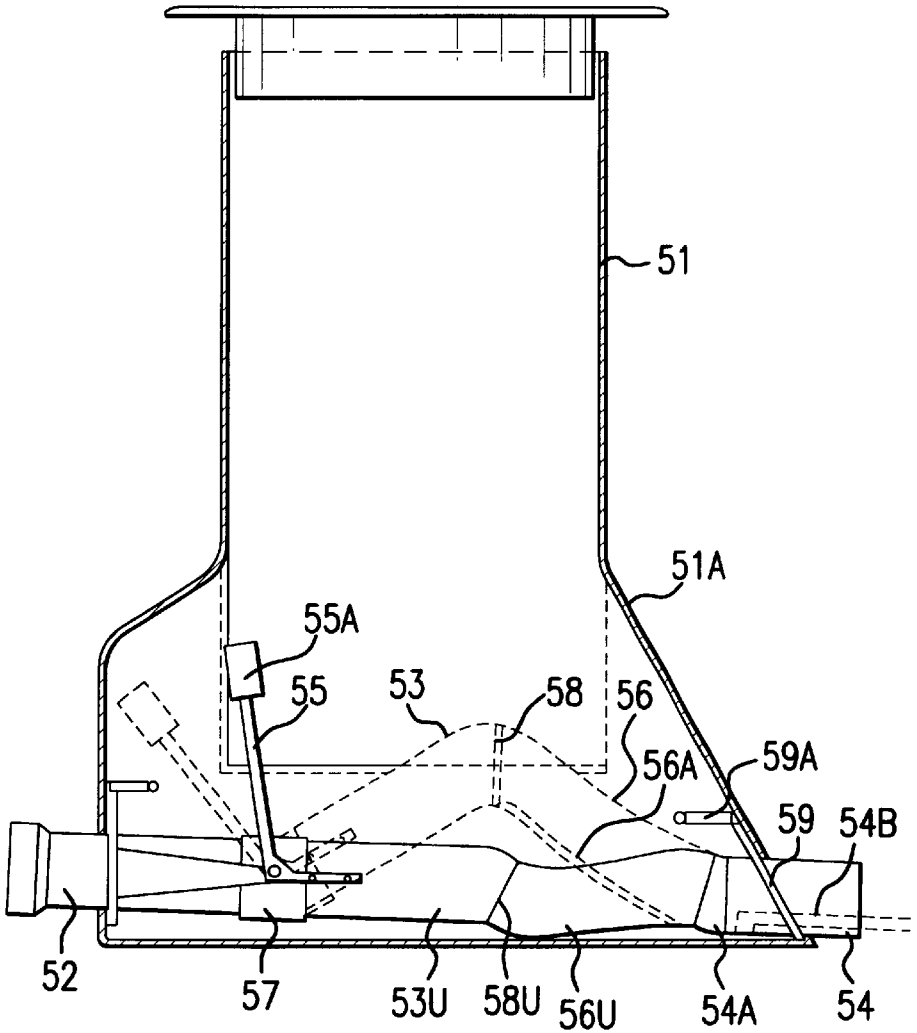

This invention relates to an apparatus for shock-like flushing in a fluid system, comprising an accumulating or blocking element which upon supply of fluid from an inlet is adapted to be set from a normal position to a flushing position where accumulated fluid flows through an outlet to a following section of the fluid system, and to subsequently be reset to normal position.

Such an apparatus can be used in connection with toilets with water flushing, where the fluid system which is to receive the backwash or waste water from toilets, often is exposed to problems because of clogging etc. This is particularly of concern by application of so-called water-saving toilets.

In most countries, the large consumption of clean water represented by the water closet, is constantly a theme of discussion, both with a view to the actual pressure water volumes which are at disposal for built-up areas and to the significant quantity of the waste water volumes represented by such toilets. A variety of water-saving toilets is for this reason proposed. Up to the present, one has not succeeded with a water-saving toilet which fully takes into account hygiene, odour, and above all the large volumes of fluid required for ensuring maintenance-free operation in order to avoid expensive clogging in the waste pipe. Recent investigations show that it is necessary with a flushing volume of 6 to 8 liters a time for removing paper and faeces in such a way that future clogging of waste pipe do not occur.

In connection with the above, there is reason to mention British Patent spesification No. 1.441.631, which relates to a toilet system where among other things there is included a tiltable accumulation container for waste or gray water from other sources, to be utilized for reinforced flushing and further transport of toilet waste down through a following waste or fluid system. Such designs based on tiltable ducts or vessels and similar forms of shock-incriminators, have bottom portions which are always exposed to sediments which cause function faults or shut-down unless maintenance is constantly done.

The present invention is not limited to utilization in connection with toilet waste pipes, but has broader applications in waste pipe or fluid systems in general. The solutions to be discussed in the following description are, however, in principle based on the same ideas as mentioned above in connection with toilets.

Prior art of interest in this connection is also represented by U.S. Pat. Nos. 4,321,948, 4,305,426 and 3,001,575 10 as well as FR 2,720,424.

Closer statements regarding the apparatus according to the invention, together with its novel and particular features are to be found in the claims.

Among the advantages of the apparatus according to the invention it can first of all be mentioned that this is quite simple and reliable, at the same time not entailing high initial expenses. It can to a great extent be built with known components or forms of pipe members, including flexible pipes. A particular advantage consists in that components which are incorporated, including internal surfaces in pipe members in the construction, are flushed and cleaned at each shock-like flushing, in such a way that the risk of fouling and sedimentation or deposition is substantially eliminated.

Even if the embodiments described in the following are based on waste water or sewage, it is clear that the described apparatuses can work with clean water from a normal water supply as well, if this is desirable. This can e.g. be the case when such separate or extra water supply is required for in given situations to attain a sufficiently powerful flushing and cleaning.

Figure 2:
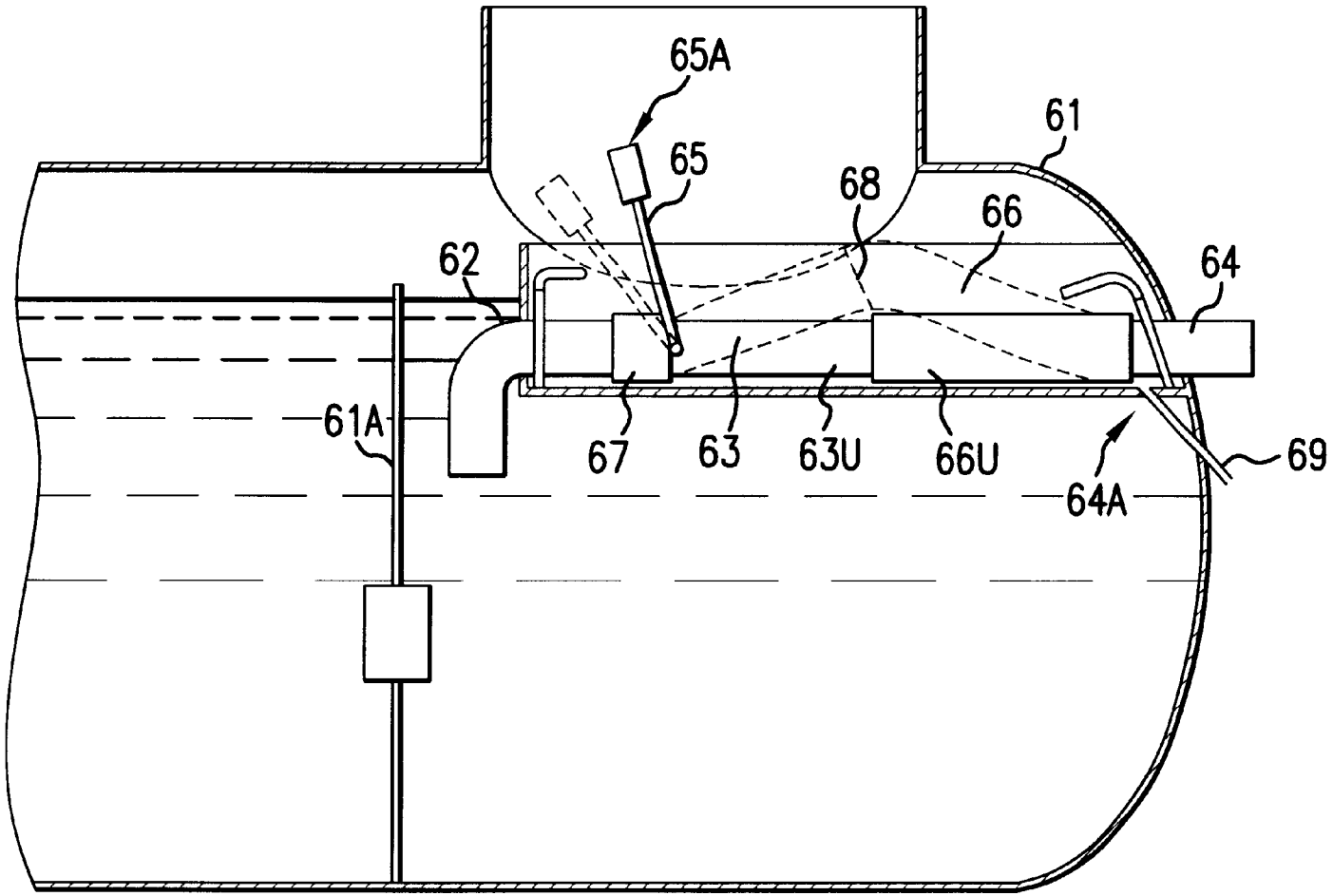
Figure 4:
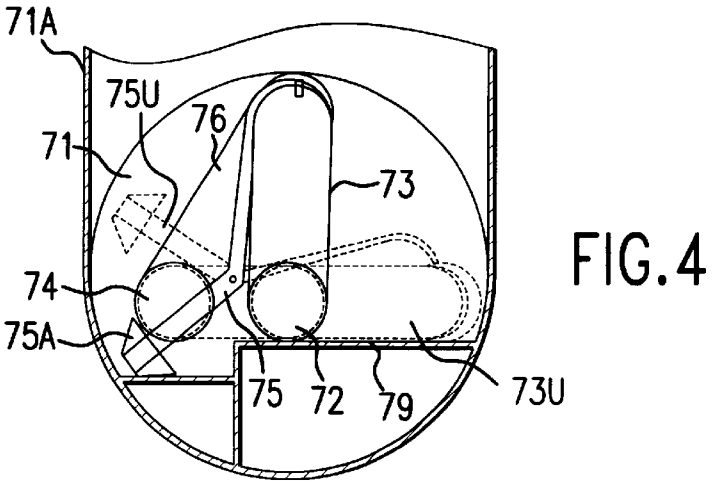
Figure 3:
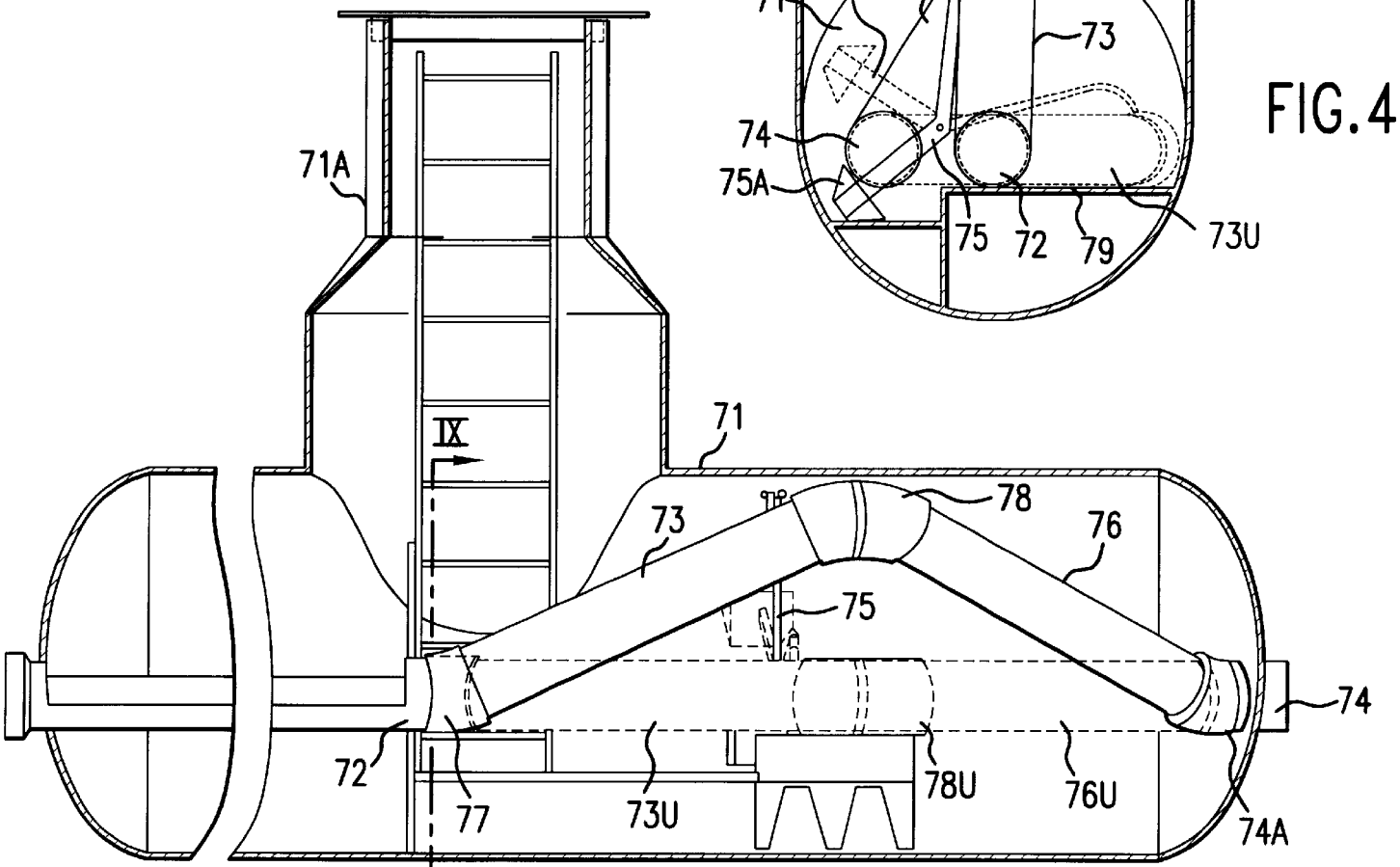
Figure 5:
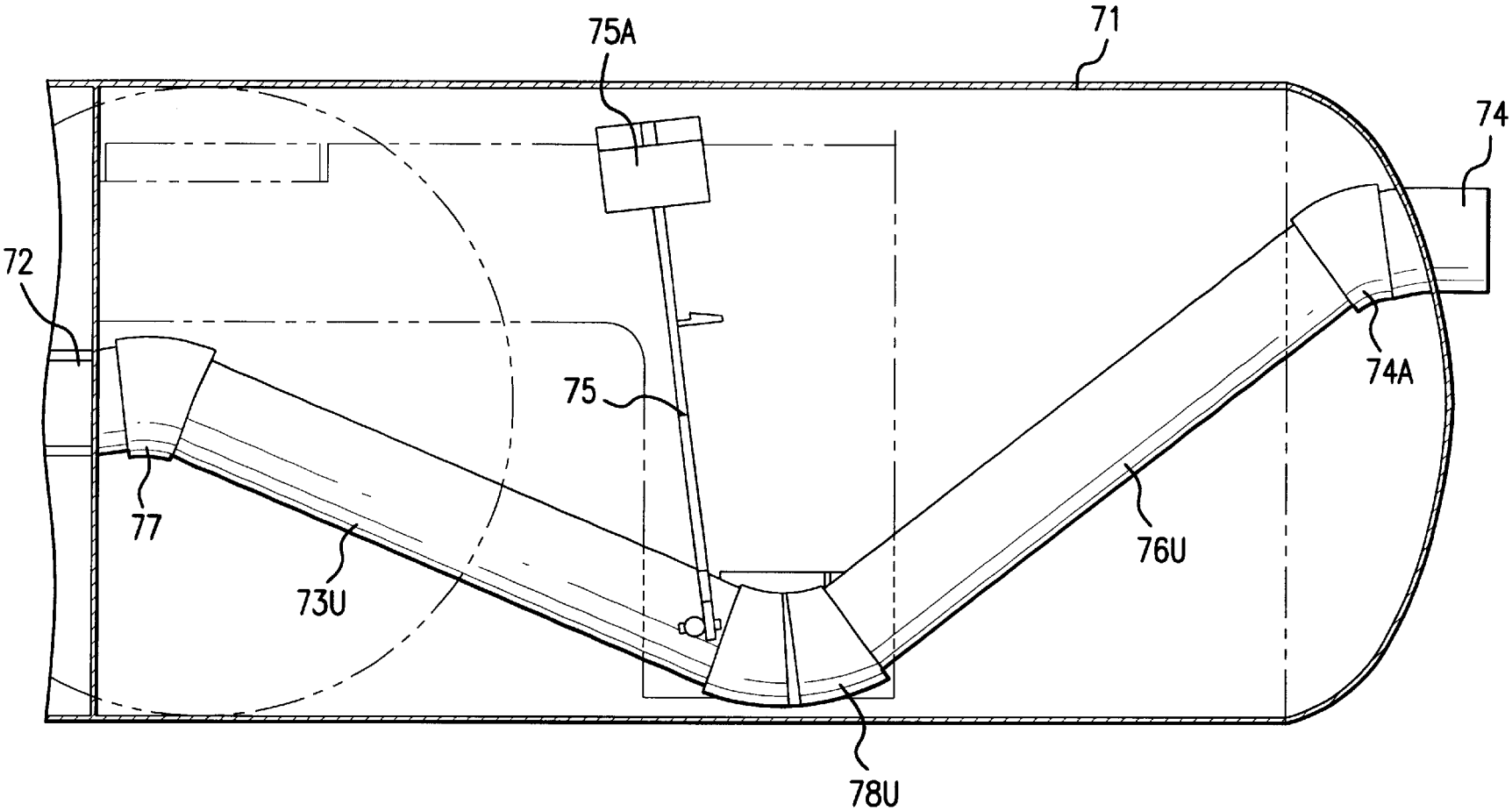
Figure 8:
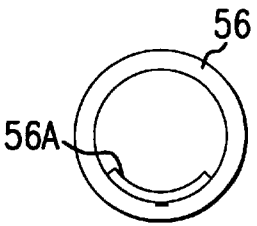
Figure 6:
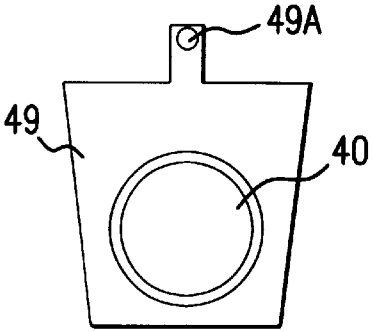
Figure 7:
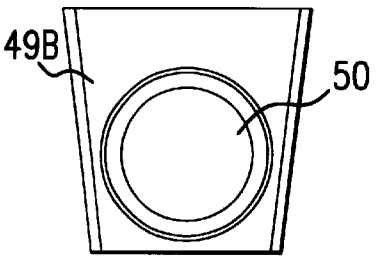

In the following the invention will be further explained with reference to the drawings, where:

FIG. 1 in vertical section shows a basin or pipe installation for flushing of a drain line or sewer conduit based on a first embodiment of the invention, FIG. 2 in vertical section shows the downstream part of an interceptor for sludge according to the first embodiment of the invention, FIG. 3 in vertical section shows an installation of larger dimensions where in a tank section there is installed an apparatus according to a second embodiment of the invention, FIG. 4 shows a cross section taken along the line IX—IX in FIG. 3, FIG. 5 shows the apparatus in FIGS. 3 and 4 as seen from above, FIG. 6 in sectional elevation shows a demountable flange part which can be included e.g. in the apparatus in FIG. 1 or 2, FIG. 7 in sectional elevation shows a fixed part of a flange part for cooperation with the part in FIG. 6, and FIG. 8 in cross section shows a particular embodiment of a flexible pipe member which can be included in one or more of the apparatuses in FIGS. 1–5.

A first embodiment of the invention is illustrated in FIG. 1. A wide pipe or a basin 56 which in the lower part passes on to a relatively narrow box 51A, where the apparatus according to the invention is installed. This can be an apparatus for flushing of a sewer or drain pipe.

In FIG. 1 there is shown an inlet 52 and an outlet 54, whereby the apparatus lying in between comprises a blocking element with two pipe members 53 and 56. These are connected to each other in a middle portion as shown at 58 and 58U, respectively, in lowered flushing position. The apparatus is based on a flexible connection which primarily can be provided in that the second or downstream pipe member 56 in its entirety is flexible. The pipe member 53, on the contrary, should be relatively rigid in order to function as the canal, duct or pipe members adapted to provide for the shock-like flushing aimed at.

Pipe member 53 has a normal, blocking position shown in dotted lines in FIG. 1, and a lowered, flushing position as shown in solid lines at 53U. The lowering movement from the inclined position to the flushing position is attained when the fluid pressure through the inlet 52 is sufficiently high, i.e. the fluid level has risen to a certain height in the inclined pipe member 53. A weight load provided by the weight SSA on a lever 55 ensures that the pipe member 53 is kept in the inclined position shown, where both the pipe member 53 and the weight with lever is shown with dotted lines. The movability of the pipe member 53 can be provided 5 for by a flexible pipe portion 57, whose downstream end is tight-fittingly connected with the inlet 52. The lever 35 is mounted at an approximately horisontal axis which runs across the pipe member 53, or more correctly, across the flexible pipe portion 57, so that the rocking movement of the weight load 55/SSA is adapted to the bending motion in the pipe portion 57. A lever part is suitably attached to the pipe member 53. The lowering movement of the pipe-shaped blocking element 53 will thus occur approximately in a vertical plane.

As it appears from the two positions which the apparatus takes up in FIG. 1, with solid lines and dotted lines, respectively, the weight 55A in the flushing position (53U) will exert a smaller momentum on the pipe member (53)

than in the blocking inclined position. Expressed in other words, the lever 55 has an effective inclined position which is more vertical during flushing than in its position corresponding to blocking inclined position of the pipe member 53. This implies a decreasing momentum of the weight load during the lowering movement.

Further, it is clear that a weight load as here shown, could be replaced with a spring load having a similar function with respect to pipe member 53

The pipe members 53 and 56 are flexibly connected with the inlet 52 through a flexible pipe portion 57, and with the outlet 54 through a corresponding preferably flexible pipe portion 54A. With a second pipe member 56 which in its entirety is flexible, no high degree of flexibility in the portion 54A is required, it is an advantage that the connection or joint plane at 58 between the two pipe members runs somewhat at an inclination in relation to the longitudinal axis of the first pipe member 53, as it particularly appears in the flushing position (53U/158U/56U) shown. This inclined position together with a correspondingly adapted length of the second pipe member 58, makes this pipe member more easily adaptable to the larger distance between the portion 54A and the highest point at 58 in blocking position, as with dashed lines shown in FIG. 1.

As a variant of what is just described, both pipe members 52 and 56 may be formed of a continuous, flexible pipe section which in that case requires a supporting frame or bridge which extends along and preferably over the first part 53 of the integrated pipe member and is preferably rigidly connected to the weight means 55/55A.

In the embodiment in FIG. 1, there exists a continuous fluid flow path from the inlet 52 to the outlet 54, as well in blocking position as in flushing position. This can be a great advantage in certain applications.

In FIG. 1 there is also shown a flange part 59/59A, here in connection with the outlet 54, but a similar device is also indicated at the inlet 52. Flange part hand lever 59A can be of assistance when fully or partly dismounting the main components including in the flushing means. Details regarding this flange part will be explained below in connection with FIGS. 6 and 7.

At the outlet 54 there is in dashed lines shown a flexible hose 54B which inside the box 51A has an opening downwardly through the bottom of the outlet 54, with the purpose of being able to drain fluid which could leak out or accumulate in the bottom of the box 51A. Thus it is prevented that accumulated fluid on the bottom of the box 51A can affect the balance conditions in the system which comprises the pipe members 53 and 56, together with the weight means 55/55A. Similar draining can of course be arranged for the remaining embodiments described. Such an internal hose will only be able to transport insignificant fluid volumes, and it will float up in the outlet 54 and the following pipe system, during flushing, and does not hinder this function.

As illustrated in FIG. 1, the pipe members 53 and 56 have approximately the same cross section, but it is clear that the flexible pipe member 56 could have a larger diameter than the pipe member 53, particularly in view of corrugation which can be advantageous with a view to the desired flexibility, in case of such an increased dimension of the pipe member 56, it is of importance that the lowest portion or bottom portion runs level with the bottom portion of the pipe portion 53. This will contribute to avoiding that accumulation of undesired sludge or similar will occur.

Finally it is mentioned in connection with FIG. 1 that on the bottom of the pipe member 56 when it is corrugated, there may be arranged an extended, flexible reed or tongue 56A which loosely lies on the bottom of the pipe portion except for a fixation close to the transition portion 58. A cross section of the pipe member 56 with such an inlaid flexible reed 56A is shown in FIG. 8. The purpose of this special feature is to reduce the wear and tear on the pipe member 56 in case of sharp gravel or similar being transported by the fluid flowing through it.

An interceptor for sludge is partly shown in FIG. 2. This can comprise several upstream or preceding chambers in connection with the last chamber 61 which here is shown in the drawing after (to the right of) a partition 61A against the last preceding chamber. The flushing means has here a good deal in common with the apparatus in FIG. 1, but in FIG. 2 is placed in a box in the upper part of the tank section 61. At the left end of this box there is shown an immersed tube 62 for the flushing means. The following main components can be found in this drawing: A flexible pipe section 67 connecting a first pipe member 63 to the inlet 62, a second, flexible pipe member 66 which at its upstream end has a connection 66 with the first pipe member 63, together with an outlet 64. Furthermore, a weight load represented by the lever 65 with an accompanying weight is included. The apparatus is shown with dotted lines in blocking position, and with solid lines in its flushing position (63U/66U). At 69 there is shown a drain pipe for draining of fluid which might occur on the bottom of the box which encloses the flushing means. It is first of all the question of condensation water needing to be removed. This can go straight into the ground when a buried interceptor for sludge is concerned.

The manner of operation is in essence as described in connection with FIG. 1, and the apparatus in FIG. 2 can e.g. through the immersed tube inlet 62 be adapted to empty up to ⅕ of the volume in the tank for removal through the outlet 64 to a downstream fluid system, such as an infiltration conduit with an accompanying manifold.

The embodiment in FIGS. 3, 4 and 5 differ in its pattern of motion from the preceding embodiments, by being based on sideways lowering movement of the blocking element. This comprises here a first pipe member 73 and a second pipe member 76 being interconnected through a flexible pipe portion 78. In its solid-drawn version in FIGS. 3 and 4, this blocking element takes up a blocking position, as fluid which is supplied through an inlet 72 accumulates and results in an increasing fluid level in the pipe member 73, until lowering and flushing occur. Flushing takes place through an outlet 74 which is connected with the downstream part of the pipe member 76, through a flexible pipe portion 74A. Similarly, there is arranged a flexible pipe portion between the inlet 72 and the upstream end of the pipe member 73. All of this is installed in a larger tank 71 with access through a tube 71A provided with a ladder.

In FIGS. 3 and 4, the blocking element 73/76 with dotted lines is shown in its lowered position, i.e. flushing position. In the same position the apparatus is shown as seen from above in FIG. 5. The lowering movement here consequently takes place sideways by rotation of the blocking element about an approximately horisontal axis or line between the inlet 72 and the outlet 74. The inlet and the outlet are, as it appears from FIG. 5, laterally shifted in relation to each other, since the inlet 72 can lie in a vertical midplane in the tank 71, while the outlet 74 has a relatively pronounced eccentric position in the cross-section of the tank. The inlet and outlet, however, are arranged with little or no level difference in the tank. With such an unsymmetrical design of the blocking element 73 76, the fluid which gradually fills up in the pipe member 73, will exert a momentum which attempts to turn the whole blocking element clockwise in FIG. 4, i.e. in the direction towards a lowered flushing position. This lowering movement occurs in spite of weight load in the form of a lever 75 with weight 75A, which attempts to keep the blocking element in the blocking position. The lever 75 with its weight is during lowering raised to the position shown with dotted lines, indicated with 7SU in FIG. 4 In accordance with the previously described embodiments, here as well there is provided for support of the components of the apparatus, particularly in lowered position, as it appears from FIG. 4 by the plate part 79 shown.

The embodiment in FIGS. 3, 4 and 5 is based on mainly rigid pipe members 73 and 76, with associated more or less flexible pipe portions 77, 78, 74A.

The apparatus in FIGS. 3, 4 and 5 could also have been provided with flange parts or couplings as drawn in FIGS. 1 and 2, and shown in more detail in FIGS. 6 and 7. In addition to what is mentioned before about such flange parts, it is worth noting that FIG. 6 shows a retractable part 49 which is essentially plate-shaped and is equipped is with a hand lever 49A. A through hole 40 agrees with the flow cross-section through the inlet. A corresponding frame or guidance part 49B is shown in FIG. 7, where there is likewise a through hole 50 corresponding to the hole 40. As it has appeared from the description above, it is here the question of practical details which can be useful by disassembling and maintenance or similar on the flushing means shown.

It is evident that the apparatuses described may have a regular mode of operation corresponding to the flushing position as explained, but can be repositioned to take up the blocking position when it is desirable to undertake shock-like flushing by means of accumulated fluid.

What is claimed is:

1. An apparatus for shock-like flushing in a fluid system, comprising an accumulating or blocking element which upon supply of fluid from an inlet is adapted to be set from a normal position to a flushing position where accumulated fluid flows through an outlet to a following section of the fluid system, and to thereafter be reset to normal position, said blocking element comprising a canal, duct or pipe member with a pivotal portion at an upstream end and with a normal position where it has at least partially an upward inclination from said pivotal portion for blocking and accumulating fluid in the canal, duct or pipe member, and the blocking element is kept in the normal inclined position by means of a weight load until a certain level of accumulated fluid is attained, whereby the blocking element is adapted to be lowered to the flushing position for fluid through-flow in the canal, duct or pipe member, and the weight load is adapted to bring the blocking element back from the flushing position to normal inclined position when a certain low fluid level is attained, characterized in that the blocking element comprises a first and second, downstream pipe member with a mutual flexible connection, and that a downstream end of said second, downstream pipe member is directly connected to said outlet.

2. An apparatus according to claim 1, characterized in that the pivotal portion is adapted to provide for said lowering movement of the blocking element in a substantially vertical plane.

3. An apparatus according to claim 1, characterized in that the blocking element is connected to the inlet through a flexible pipe portion.

4. An apparatus according to claim 1, characterized in that the second, downstream pipe member is adapted to be connected to the outlet through a second flexible pipe portion.

5. An apparatus according to claim 1, characterized in that the second, downstream pipe member is flexible in its entirety.

6. An apparatus according to claim 1, characterized in that the pivotal portion is adapted to provide for lateral lowering of the blocking element mainly about a horizontal axis in the longitudinal direction between the inlet and the outlet.

7. An apparatus according to claim 6, characterized in that the outlet is laterally offset in relation to the center line of the inlet.

8. An apparatus according to claim 1, characterized in that a weight load affects the blocking element through a lever which in the flushing position takes up a more vertical orientation than it does in normal inclined position of the blocking element.

* * * * *